US009892818B2

(12) United States Patent
Takada et al.

(10) Patent No.: US 9,892,818 B2
(45) Date of Patent: Feb. 13, 2018

(54) ALUMINUM ALLOY HAVING EXCELLENT ANODIC OXIDATION TREATABILITY, AND ANODIC-OXIDATION-TREATED ALUMINUM ALLOY MEMBER

(71) Applicant: Kobe Steel, Ltd., Kobe-shi (JP)

(72) Inventors: Satoru Takada, Kobe (JP); Kazunori Kobayashi, Moka (JP); Toshiyuki Tanaka, Inabe (JP); Kenichi Inoue, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 164 days.

(21) Appl. No.: 14/407,559

(22) PCT Filed: Jul. 10, 2013

(86) PCT No.: PCT/JP2013/068870
§ 371 (c)(1),
(2) Date: Dec. 12, 2014

(87) PCT Pub. No.: WO2014/017297
PCT Pub. Date: Jan. 30, 2014

(65) Prior Publication Data

US 2015/0136608 A1 May 21, 2015

(30) Foreign Application Priority Data

Jul. 26, 2012 (JP) ..... 2012-166329

(51) Int. Cl.

| | |
|---|---|
| ***H01B 3/10*** | (2006.01) |
| ***C22C 21/08*** | (2006.01) |
| ***C25D 11/04*** | (2006.01) |
| ***C25D 9/06*** | (2006.01) |
| ***C22C 21/06*** | (2006.01) |

(52) U.S. Cl.
CPC ..... *H01B 3/10* (2013.01); *C22C 21/06* (2013.01); *C22C 21/08* (2013.01); *C25D 9/06* (2013.01); *C25D 11/04* (2013.01)

(58) Field of Classification Search
None
See application file for complete search history.

(56) References Cited

U.S. PATENT DOCUMENTS 4,606,796 A * 8/1986 Hanazima ..... C25D 11/18 205/174
2003/0150530 A1 8/2003 Lin et al.
2003/0205479 A1 11/2003 Lin et al.
2006/0260947 A1* 11/2006 Kia ..... C25D 5/50 205/173
2009/0038946 A1 2/2009 Ohmi et al.
2011/0177355 A1 7/2011 Ohmi et al.
2012/0067425 A1 3/2012 Yuuya et al.
2012/0247961 A1 10/2012 Ohmi et al.

FOREIGN PATENT DOCUMENTS

| | | | |
|---|---|---|---|
| CN | 1628181 | A | 6/2005 |
| JP | 11-151870 | A | 6/1999 |
| JP | 2002-241992 | A | 8/2002 |
| JP | 2002-256488 | A | 9/2002 |
| JP | 2003-119540 | A | 4/2003 |
| JP | 2003-171727 | A | 6/2003 |
| JP | 2004-143559 | | 5/2004 |
| JP | 2004332002 | A * | 11/2004 |
| JP | 2009-79286 | | 4/2009 |
| JP | 2010-283342 | A | 12/2010 |
| JP | 2012-93517 | | 5/2012 |
| WO | WO 2006/134737 | A1 | 12/2006 |
| WO | WO 2010/013705 | A1 | 2/2010 |

OTHER PUBLICATIONS

JP 2004_332002_MT. Nov. 25, 2004.*
JP 2004_143559_MT. May 20, 2004.*
Extended Search Report dated Mar. 8, 2016 in European Patent Application No. 13823540.3.
International Search Report and Written Opinion of the International Searching Authority dated Oct. 8, 2013 in PCT/JP2013/068870 Filed Jul. 10, 2013.
"Metal Structure and Anticorrosion", Hu Dechang, Beijing, China Astronautic Publishing Co., Ltd., Dec. 1987 (with English Translation).
"Surface Science and Engineering", Gao Zhi, East China University of Science and Technology Press, Jan. 2006, p. 207 (with English Translation).

* cited by examiner

*Primary Examiner* — Vera Katz
(74) *Attorney, Agent, or Firm* — Oblon, McClelland, Maier & Neustadt, L.L.P.

(57) ABSTRACT

An aluminum alloy comprising more than 3.5% and up to 6.0% of Mg, 0.02 to 1.0% inclusive of Cu, 0.02 to 0.1% inclusive of Cr, and a remainder made up by Al and unavoidable impurities, wherein the contents of Si and Fe in the unavoidable impurities are limited to 0.05% or less and 0.05% or less, respectively, and wherein the number of intermetallic compound particles contained in the aluminum alloy and having a maximum length of 4 μm or more is 50 particles or less per 1 $mm^2$ of an arbitrary cross-sectional area of the aluminum alloy. An aluminum alloy is provided, which has excellent anodic-oxidation-treatability and can be used for providing an anodic-oxidation-treated aluminum alloy member having high withstand voltage properties and such excellent heat resistance that the occurrence of cracking under high temperatures conditions can be prevented.

11 Claims, No Drawings

ALUMINUM ALLOY HAVING EXCELLENT ANODIC OXIDATION TREATABILITY, AND ANODIC-OXIDATION-TREATED ALUMINUM ALLOY MEMBER

TECHNICAL FIELD

The present invention relates to an insulating member for electronics, the insulating member comprising an anodic-oxidation-treated aluminum alloy member, and aluminum alloy for the insulating member. Examples of the insulating member include insulating members for semiconductor manufacturing equipment and for semiconductor. An anodic-oxidation-treated aluminum alloy member having an anodic oxide film on an aluminum alloy substrate is used, as the insulating member for semiconductor manufacturing equipment, for a vacuum chamber to be used in a manufacturing facilities of semiconductor or liquid crystal, the facilities including a dry etching apparatus, a chemical vapor deposition (CVD) apparatus, an ion implantation apparatus, and a sputtering apparatus. Alternatively, the insulating member is used as a material of a component provided in the inside of the vacuum chamber. Moreover, the anodic-oxidation-treated aluminum alloy member is used, as the insulating member for semiconductor, for an insulating member for semiconductor such as CPU (Central Processing Unit), a power device, and LED (Light Emitting Diode), or for an insulating member for liquid crystal. In particular, the invention suitably relates to an anodic-oxidation-treated aluminum alloy member having improved withstand voltage properties while occurrence of cracking at high temperature is suppressed, and relates to an aluminum alloy for producing such an anodic-oxidation-treated aluminum alloy member.

BACKGROUND ART

There has been widely practiced anodic oxidation treatment in which an anodic oxide film is formed on a surface of a member including, as a substrate, aluminum, aluminum alloy, or the like to improve plasma resistance and gaseous corrosion resistance of the substrate. For example, a vacuum chamber used in a plasma treatment apparatus in a semiconductor manufacturing facility or each of various components provided in the inside of the vacuum chamber typically comprises aluminum alloy. However, if the aluminum alloy member is used for such an application while being not treated (while being solid, or as it is formed into a component), the component cannot maintain its plasma resistance, gaseous corrosion resistance, and the like. Consequently, an anodic oxide film is formed on a surface of the member comprising aluminum alloy to improve the plasma resistance, the gaseous corrosion resistance, and the like.

In recent years, power to be applied for plasma generation increases with increase in plasma density due to narrowed interconnection width. In existing anodic oxide films, therefore, dielectric breakdown may be induced by high temperature and high voltage occurring at high power application. Etching uniformity or film formation uniformity is degraded due to varied electric properties at a portion where such dielectric breakdown has occurred; hence, a member to be used is desired to have excellent withstand voltage properties and excellent hot cracking resistance (heat resistance). The insulating member for semiconductor is recently used in a higher temperature environment associated with higher density, smaller size, and higher power of semiconductor, and is recently subjected to higher temperature during a manufacturing process of semiconductor; hence the insulating member is also necessary to have excellent withstand voltage properties and excellent hot cracking resistance (heat resistance). In addition, it is also an important requirement to achieve such demand characteristics at low cost.

There have been proposed various techniques for improving properties of the aluminum alloy member having the anodic oxide film thereon. For example, PTL 1 proposes a technique for improving withstand voltage properties by using an aluminum alloy having higher purity as a substrate to decrease the number of intermetallic compound particles. However, film cracking may occur under high temperature in such an anodic-oxidation-treated aluminum alloy member that is therefore not improved in hot cracking resistance.

PTL 2 proposes an aluminum-alloy metal substrate with an insulating layer for a solar cell, which is improved in withstand voltage properties by minimizing metallic silicon in the aluminum alloy. This technique also does not consider the hot cracking resistance; hence, film cracking may occur under high temperature in the metal substrate.

CITATION LIST

Patent Literature

PTL 1: Japanese Unexamined Patent Application Publication No. 2002-241992.

PTL 2: Japanese Unexamined Patent Application Publication No. 2010-283342.

SUMMARY OF INVENTION

Technical Problem

An object of the invention, which has been made in light of the above-described circumstances, is to provide an anodic-oxidation-treated aluminum alloy member having excellent withstand voltage properties and excellent heat resistance that suppresses occurrence of cracking under high temperature, and an aluminum alloy having excellent anodic oxidation treatability for providing such an anodic-oxidation-treated aluminum alloy member.

Solution to Problem

An aluminum alloy of the present invention, by which the object is achieved, is characterized by containing more than 3.5% and 6.0% or less of Mg (by mass percent (the same applies to the following for the chemical components)), 0.02 to 1.0% inclusive of Cu, 0.02 to 0.1% inclusive of Cr, and the remainder consisting of Al and unavoidable impurities, in which the content of each of Si and Fe in the unavoidable impurities is limited to 0.05% or less, and the number of intermetallic compound particles contained in the aluminum alloy and having a maximum length of 4 μm or more is 50 or less per square millimeter in an appropriate section of the aluminum alloy.

The aluminum alloy of the invention may further contain 0.5% or less of Zn. The number of intermetallic compound particles per square millimeter is preferably 15 or less.

An anodic oxide film is formed on a surface of a substrate comprising an aluminum alloy as described above, and thereby it is possible to provide an anodic-oxidation-treated aluminum alloy member having excellent withstand voltage properties and excellent heat resistance that suppresses occurrence of cracking under high temperature. The anodic oxide film is preferably formed with an anodic oxidation treatment solution containing at least oxalic acid. The anodic oxide film preferably has a thickness of 3 to 150 μm inclusive from the viewpoint of reducing occurrence of hot cracking and securing withstand voltage properties.

Advantageous Effects of Invention

According to the invention, the aluminum alloy used as the substrate is appropriately defined in chemical composition and in size and number of intermetallic compound particles. It is therefore possible to provide an anodic-oxidation-treated aluminum alloy member having excellent withstand voltage properties and excellent heat resistance together. Such an anodic-oxidation-treated aluminum alloy member is extremely useful as a member for manufacturing facilities of semiconductor or liquid crystal, and as an insulating member for power semiconductor.

DESCRIPTION OF EMBODIMENTS

The inventors have made investigations from various angles to provide an anodic-oxidation-treated aluminum alloy member having excellent withstand voltage properties and excellent heat resistance together. As a result, they have found that when an aluminum alloy used as the substrate is appropriately defined in chemical composition and in size and number of intermetallic compound particles, the aluminum alloy is allowed to have excellent anodic oxidation properties, and when an anodic oxide film is formed on a surface of such an aluminum alloy with an anodic oxidation treatment solution containing at least oxalic acid, the anodic-oxidation-treated aluminum alloy member, by which the above-described object is achieved, can be provided, and have completed the invention. The following description focuses on the individual requirements defined in the invention.

The aluminum alloy used as the substrate in the invention contains a predetermined amount of each of Mg, Cu, and Cr. The reason for defining a range of each of the components is as follows.

(Mg: More than 3.5% and 6.0% or Less)

The anodic oxide film itself is weak against tensile stress; hence, strength of the substrate is necessary to be maximized in order to compensate such properties to improve hot cracking performance of the anodic oxide film. In the case of the insulating member for semiconductor, when its strength is increased, substrate thickness can be decreased and thus thermal resistance can be reduced, leading to improvement in radiation performance. In light of this, the Mg content in the aluminum alloy used as the substrate is maximized. In addition, an increased Mg content in the aluminum alloy increases film formation rate of the anodic oxide film, leading to reduction in manufacturing cost. For this reason, the Mg content in the aluminum alloy is necessary to be more than 3.5%. The Mg content is preferably 3.6% or more. However, if the Mg content is excessive to exceed 6.0%, a rolling crack is likely to occur in the aluminum alloy that is thus difficult to be rolled. The upper limit of the Mg content is preferably 5.3% or less, and more preferably 4.7% or less.

(Cu: 0.02 to 1.0% Inclusive)

Cu is an element effective for improving heat resistance, which is particularly significant in the presence of Mg. In light of this, Cu is necessary to be contained by 0.02% or more.

The Cu content is preferably 0.03% or more. However, if the Cu content is excessive to exceed 1.0%, Cu is precipitated in a form of an intermetallic compound, causing degradation in withstand voltage properties. The upper limit of the Cu content is preferably 0.8% or less.

(Cr: 0.02 to 0.1% Inclusive)

Cr is an element effective for increasing strength (due to refining of recrystallized grains) as with Mg. Cr is necessary to be contained by 0.02% or more to exhibit such an effect. The Cr content is preferably 0.03% or more, and more preferably 0.04% or more. However, excessive Cr content of more than 0.1% causes coarsening of crystallized grains. The upper limit of the Cr content is preferably 0.08% or less, and more preferably 0.07% or less.

The aluminum alloy of the invention contains the basic components as described above, while the remainder consists of Al and unavoidable impurities. The unavoidable impurities include Si and Fe that are each necessary to be controlled in content as follows. The aluminum alloy may further contain a small amount of Z.

(Si: 0.05% or Less, Fe: 0.05% or Less)

Fe forms Al—Fe intermetallic compounds, and Si forms Mg—Si intermetallic compounds. Such intermetallic compounds cause degradation in withstand voltage properties. Hence, each of Si and Fe is necessary to be controlled to be 0.05% or less in order to adjust the size and the number of the intermetallic compound particles to be equal to or smaller than predetermined size and number. The content of each of Si and Fe is preferably 0.02% or less to secure further excellent withstand voltage properties. While the lower limit of each of such elements may not be specifically defined, since the content thereof of less than 0.002% requires an extremely expensive aluminum alloy ingot, the content of each element is preferably 0.002% or more.

(Zn: 0.5% or Less)

An element that is uniformly solid-solutionized in the aluminum alloy, such as Zn, does not affect the withstand voltage properties, and therefore may be contained in the aluminum alloy. In the case of Zn, if its content exceeds 0.5%, a precipitation nuclei of Zn is enlarged, and grain boundaries are deeply etched and defects are formed during pretreatment etching that is therefore surface treatment giving inappropriate surface state.

The Zn content is preferably 0.3% or less. While the lower limit of Zn may not be defined, since the content thereof of less than 0.002% requires an extremely expensive aluminum alloy ingot, the content of Zn is preferably 0.002% or more.

(Size and Number of Intermetallic Compound Particles)

A cause of degrading the withstand voltage properties is that the intermetallic compound particles in the aluminum alloy are incorporated into the film in a substantially metal state without being dissolved during anodic oxidation. As the size of the intermetallic compound particles is larger, surface area per mass is smaller, and longer time is taken for dissolution. Consequently, as a condition that the intermetallic compound particles do not significantly affect the withstand voltage properties while being not completely dissolved, the number of intermetallic compound particles having a size (maximum length) of 4 μm or more is necessary to be up to 50 per square millimeter ($50/mm^2$) in an appropriate section. If such a requirement is satisfied, sufficient withstand voltage properties can be provided. To further increase the withstand voltage, the number is preferably up to $15/mm^2$ (more preferably up to $10/mm^2$). The intermetallic compound particles to be measured in the invention are Al—Fe intermetallic compound particles or Mg—Si intermetallic compound particles.

The anodic-oxidation-treated aluminum alloy member of the invention is configured by forming an anodic oxide film on a surface of a substrate comprising the aluminum alloy as described above. The anodic oxide film is preferably formed with an anodic oxidation treatment solution containing at least oxalic acid. This is because an oxalic acid-based film is formed as the anodic oxide film on the aluminum alloy substrate, and thereby crack resistance at high temperature can be improved.

Specifically, while a typical anodic oxidation treatment solution includes organic acids such as oxalic acid and formic acid, and inorganic acids such as phosphoric acid, chromic acid, and sulfuric acid, an anodic oxidation treatment solution containing at least oxalic acid is preferably used from the viewpoint of improvement in withstand voltage properties while crack occurrence at high temperature is significantly decreased. The concentration of oxalic acid in the anodic oxidation treatment solution should be appropriately controlled such that desired functions and effects can be effectively exhibited, and is preferably controlled to be within a range from about 20 to 40 g/L inclusive.

The temperature (solution temperature) at the anodic oxidation treatment should be set without reducing productivity and within a range without inducing significant dissolving of the film, and is preferably set at about 0 to 50° C. inclusive. On a low temperature side, although film formation rate is low, a dense film is formed and thus the withstand voltage tends to be higher. On a high temperature side, although film formation rate is high, the withstand voltage tends to be slightly lower. Hence, the temperature should be appropriately set in light of both of productivity and required withstand voltage properties. In consideration of productivity and withstand voltage properties, a film structure may be formed through the low temperature treatment and the high temperature treatment in combination to ensure the productivity and the withstand voltage properties together.

The bath voltage (anodic oxide film formation voltage) and the current density in the anodic oxidation treatment should be appropriately adjusted such that a desired anodized oxide film is produced. For example, with the bath voltage, when the bath voltage is low, current density is small and thus film formation rate is low. When the bath voltage is too high, the film may be dissolved due to a large current and thus the anodic oxide film tends to be not formed. Since influence of the bath voltage also depends on a composition of an electrolytic treatment solution to be used and temperature of the anodic oxidation treatment, the composition and the temperature should be appropriately set. More preferably, the film structure is formed as a multilayer structure, thereby the withstand voltage properties of the film can be improved. The reason for this is as follows. The oxalic-acid-based anodic oxide film is configured of a porous layer (a major part of the film) and a barrier layer (neighborhood of the substrate), and the porous layer includes pipe-shaped pores extending in a thickness direction and is therefore less insulative. However, when such pipe-shaped pores are formed to be discontinuous (i.e., formed into a multilayer structure), an electron avalanche phenomenon causing dielectric breakdown is suppressed, leading to improvement in withstand voltage properties. Moreover, since the pore size can be controlled by the treatment voltage (the pore size increases with increase in treatment voltage), the film structure can be controlled by discontinuously varying the treatment voltage.

Specifically, the voltage (bath voltage) in the anodic oxidation treatment is preferably about 5 to 100 V inclusive (more preferably 15 to 80 V inclusive). Alternatively, current density of the applied current during the anodic oxidation treatment is preferably up to 100 A/dm$^2$ (more preferably up to 30 A/dm$^2$, and most preferably up to 5 A/dm$^2$). Since such conditions each also depend on a composition of an electrolytic treatment solution to be used, temperature of the anodic oxidation treatment, and a chemical composition of the aluminum alloy, each of them should be appropriately set.

The thickness of the resultant anodic oxide film is an important factor responsible for the withstand voltage properties, and should be adjusted according to a relevant specification. Although the thickness may not be specifically limited since hot cracking is less likely to occur with smaller thickness, a large thickness degrades the hot crack resistance; hence, the thickness is preferably 150 μm or less, and more preferably 100 μm or less.

To ensure the withstand voltage properties required for the film as a whole, the film thickness is preferably 3 μm or more depending on a type of the semiconductor manufacturing equipment, a process, and the withstand voltage properties per unit thickness (per micrometer), which is preferably 50 V or higher per micrometer, and more preferably 60 V or higher per micrometer. The film thickness is more preferably 10 μm or more (most preferably 20 μm or more).

Although the invention is now described in detail with an embodiment, the invention should not be limited thereto, and modifications or alterations thereof may be made within the scope without departing from the gist described before and later, all of which are included in the technical scope of the invention.

This application claims the benefit of Japanese Priority Patent Application JP 2012-166329 filed on Jul. 26, 2012, the entire contents of which are incorporated herein by reference.

Embodiment

An aluminum alloy having a chemical composition shown in Table 1 was melted and casted into a slab in a typical manner. The slab was subjected to soaking at a temperature of 500° C., and was subsequently hot-rolled into a hot-rolled sheet 5 mm in thickness. Subsequently, the hot-rolled sheet was cold-rolled into a thickness of 0.8 mm, and was then annealed at a temperature of 350° C., and was then cut into substrates each having dimensions of 30 mm long, 30 mm wide, and 0.8 mm thick.

Each of the specimens (substrates) cut as described above was subjected to a degreasing step in which the specimen was immersed for 2 min in a 50° C.-15% NaOH solution and then rinsed. The specimen subjected to the degreasing step was subsequently subjected to a desmutting step in which the specimen was immersed for 2 min in a 40° C.-20% nitric acid solution, and then rinsed to wash the surface of the specimen.

TABLE 1

| | Chemical composition* (mass %) | | | | | |
|---|---|---|---|---|---|---|
| Test No. | Si | Fe | Cu | Mg | Cr | Zn |
| 1 | 0.010 | 0.011 | 0.05 | 4.1 | 0.06 | 0.13 |
| 2 | 0.015 | 0.015 | 0.12 | 3.8 | 0.05 | 0.12 |
| 3 | 0.009 | 0.012 | 0.50 | 4.4 | 0.04 | 0.10 |
| 4 | 0.012 | 0.015 | 0.04 | 4.0 | 0.06 | 0.15 |
| 5 | 0.043 | 0.040 | 0.05 | 3.9 | 0.05 | 0.10 |
| 6 | 0.074 | 0.26 | 0.01 | 2.6 | 0.17 | — |
| 7 | 0.014 | 0.017 | 0.30 | 3.8 | 0.05 | — |

TABLE 1-continued

| Test No. | Chemical composition* (mass %) | | | | | |
|---|---|---|---|---|---|---|
| | Si | Fe | Cu | Mg | Cr | Zn |
| 8 | 0.010 | 0.011 | 0.05 | 4.1 | 0.06 | 0.13 |
| 9 | 0.014 | 0.41 | 0.21 | 4.2 | 0.05 | 0.16 |

*remainder: Al and unavoidable impurities other than Si and Fe

Subsequently, each of the specimens was subjected to anodic oxidation treatment at a condition (including a treatment solution type, treatment solution concentration, treatment solution temperature, and bath voltage) shown in Table 2 to produce an anodic oxide film having a predetermined thickness. After the anodic oxidation treatment, the specimen was rinsed and dried, so that various anodic-oxidation-treated aluminum alloy members, each having an anodic oxide film on a substrate surface, were produced. Among them, Test No. 8 has a double-layered structure with a total thickness of 33 μm, which was formed in such a manner that a first film was formed 8 μm at a treatment voltage (bath voltage) of 30 V, and then a second film was formed 25 μm at an increased treatment voltage (bath voltage) of 60 V.

TABLE 2

| Test No. | Treatment solution type | Treatment solution concentration (g/L) | Treatment solution temperature (° C.) | Bath voltage (V) | Thickness (μm) |
|---|---|---|---|---|---|
| 1 | Oxalic acid + sulfuric acid | 25 + 0.5 | 15 | 80 | 34 |
| 2 | Oxalic acid + sulfuric acid | 25 + 0.5 | 15 | 80 | 30 |
| 3 | Oxalic acid + sulfuric acid | 25 + 0.5 | 15 | 80 | 53 |
| 4 | Oxalic acid | 35 | 37 | 40 | 30 |
| 5 | Oxalic acid | 35 | 37 | 40 | 59 |
| 6 | Oxalic acid + sulfuric acid | 25 + 0.5 | 15 | 80 | 32 |
| 7 | Oxalic acid | 35 | 37 | 40 | 71 |
| 8 | Oxalic acid | 35 | 15 | 30→60 | 33(8 + 25) |
| 9 | Oxalic acid | 35 | 37 | 40 | 34 |

Each of substrates being still not subjected to anodic oxidation treatment was measured in size and number of the intermetallic compound particles in the substrate by the following method, and the resultant anodic-oxidation-treated aluminum alloy members (Test Nos. 1 to 9) were evaluated in occurrence of hot cracking and withstand voltage properties (average withstand voltage) by the following method. Table 3 shows the results.

(Measurement of Size and Number of Intermetallic Compound Particles)

The aluminum alloy sheet (being still not subjected to anodic oxidation treatment) was cut into a piece that was then embedded in resin. A section (an appropriate section) of the piece was polished into a mirror surface, and the mirror-finished surface was observed at 20 visual fields with ×500 reflection electron images by a scanning electron microscope (SEM). A more whitish or blackish portion than a parent phase was considered to be the intermetallic compound to be measured, and the maximum length thereof was determined through image processing. The number of intermetallic compound particles having a maximum length of 4 μm or more was measured, and thus the number of the particles per area (number density: number per square millimeter) was calculated.

(Measurement of Average Withstand Voltage)

The withstand voltage of each specimen was determined with a withstanding voltage tester ("TOS5051A" from KIKUSUI ELECTRONICS CORPORATION, DC mode) in such a manner that a plus terminal was connected to a needle probe and was vertically brought into contact with the anodic oxide film, a minus terminal was connected to the aluminum alloy substrate, a DC voltage (DC current) was applied, and an average (average of ten measurements) of voltages at points, at each of which a current of 1 mA or more flowed, was determined as the average withstand voltage.

The average withstand voltage was determined for each of the formed anodic oxide films, and was then divided by the thickness of each of the anodic oxide films, thereby withstand voltage per thickness (V/μm) was determined for each anodic oxide film. High withstand voltage per thickness makes it possible to reduce film thickness for securing a specified withstand voltage, and thus improves productivity and reduces manufacturing cost, and consequently allows low cost fabrication. Hence, it was defined that a value of the withstand voltage per thickness of 50 V/μm or more was acceptable (○), and a value thereof of 60 V/μm or more was excellent (◎), while a value thereof of less than 50 V/μm was unacceptable (x).

(Evaluation of Occurrence of Hot Cracking)

Occurrence of cracking was evaluated in such a manner that each anodic-oxidation-treated aluminum alloy member was heated to 300° C., and the surface of the aluminum alloy member was then observed by a microscope (at a magnification of ×400) to evaluate the occurrence of cracking. It was determined that when a crack was obviously found in the surface of the anodic oxide film, crack resistance was bad (shown as "found" in Table 3), and when no crack was visibly found, crack resistance was good (shown as "not found" in Table 3).

TABLE 3

| Test No. | Properties | | | |
|---|---|---|---|---|
| | Number of intermetallic compound particles (per square millimeter) | Average withstand voltage (V/μm) | Evaluation of withstand voltage | Occurrence of hot cracking |
| 1 | 8 | 81 | ◎ | Not found |
| 2 | 11 | 77 | ◎ | Not found |
| 3 | 9 | 72 | ◎ | Not found |
| 4 | 8 | 76 | ◎ | Not found |
| 5 | 46 | 54 | ○ | Not found |
| 6 | 200 | 43 | X | Found |
| 7 | 13 | 62 | ◎ | Not found |
| 8 | 8 | 90 | ◎ | Not found |
| 9 | 294 | 35 | X | Not found |

The following consideration can be made from such results. First, Test Nos. 1 to 5, 7, and 8 are Examples that each satisfy the requirements defined in the invention, each of which has good withstand voltage properties and shows no crack at high temperature.

In contrast, Test Nos. 6 and 9 are each a comparative example with a substrate of an aluminum alloy that does not satisfy the chemical composition defined in the invention, and are each degraded in one of the properties. Specifically, Test No. 6, in which an aluminum alloy having insufficient Mg content is used as the substrate (Si, Fe, Cu, and Cr are each also out of the range defined in the invention), has an increased number of intermetallic compound particles due to excessive amount of Si and Fe, has insufficient withstand voltage properties, and shows cracks at high temperature due to lack of Cu. Test No. 9, in which an aluminum alloy having excessive Fe content is used as the substrate, has an increased number of intermetallic compound particles and insufficient withstand voltage properties.

INDUSTRIAL APPLICABILITY

In the invention, the chemical composition is appropriately adjusted, and the number of intermetallic compound particles contained in the aluminum alloy and having a maximum length of 4 μm or more is adjusted to 50 or less per square millimeter in an appropriate section of the aluminum alloy. It is thereby possible to provide an aluminum alloy having excellent anodic oxidation treatability for providing an anodic-oxidation-treated aluminum alloy member having excellent withstand voltage properties and excellent heat resistance that suppresses occurrence of cracking under high temperature.

The invention claimed is:

1. An aluminum alloy, comprising: by mass percent,
more than 3.5% and 6.0% or less of Mg,
0.3 to 1.0% of Cu,
0.02 to 0.1% of Cr, and
the remainder being Al and unavoidable impurities,
wherein the unavoidable impurities comprise Si and Fe, each of which in a mass content of 0.05% or less, and
wherein the aluminum alloy comprises 50 or less intermetallic compound particles having a maximum length of 4 μm or more per square millimeter of the aluminum alloy.

2. The aluminum alloy according to claim 1, further comprising
0.5% or less of Zn by mass percent.

3. The aluminum alloy according to claim 1, wherein the aluminum alloy comprises 15 or less of the intermetallic compound particles having the maximum length of 4 μm or more per square millimeter of the aluminum alloy.

4. An anodic-oxidation-treated aluminum alloy member, wherein an anodic oxide film is provided on a surface of a substrate comprising the aluminum alloy according to claim 1.

5. The anodic-oxidation-treated aluminum alloy member according to claim 4, wherein the anodic oxide film is an oxalic-acid-based anodic oxide film formed with an anodic oxidation treatment solution comprising oxalic acid.

6. The anodic-oxidation-treated aluminum alloy member according to claim 5, wherein the oxalic-acid-based anodic oxide film is a multilayer oxalic-acid-based anodic oxide film.

7. The anodic-oxidation-treated aluminum alloy member according to claim 6, wherein the multilayer oxalic-acid-based anodic oxide film comprises a porous layer and a barrier layer.

8. The anodic-oxidation-treated aluminum alloy member according to claim 7, wherein the porous layer comprises pipe-shaped pores extending in a thickness direction of the film.

9. The anodic-oxidation-treated aluminum alloy member according to claim 4, wherein the anodic oxide film has a thickness of 3 to 150 μm.

10. The anodic-oxidation-treated aluminum alloy member according to claim 4, wherein the anodic oxide film has a thickness of 30 to 150 μm.

11. The aluminum alloy according to claim 1, wherein the intermetallic compound particles are Al—Fe intermetallic compound particles or Mg—Si intermetallic compound particles.

* * * * *